US006659110B2

(12) United States Patent
Förnsel et al.

(10) Patent No.: US 6,659,110 B2
(45) Date of Patent: Dec. 9, 2003

(54) METHOD AND APPARATUS FOR CLEANING DRUMS OR BELTS

(75) Inventors: Peter Förnsel, Spenge (DE); Christian Buske, Steinhagen (DE)

(73) Assignee: PlasmaTreat GmbH, Steinhagen (DE)

( * ) Notice: Subject to any disclaimer, the term of this patent is extended or adjusted under 35 U.S.C. 154(b) by 205 days.

(21) Appl. No.: 09/885,483

(22) Filed: Jun. 20, 2001

(65) Prior Publication Data

US 2002/0002982 A1 Jan. 10, 2002

(30) Foreign Application Priority Data

Jul. 5, 2000 (DE) ..... 100 32 753

(51) Int. Cl.[7] ..... C25F 5/00

(52) U.S. Cl. ..... 134/1.1; 134/2; 134/31; 134/32; 134/34; 134/37; 219/121.4; 219/121.41; 219/121.48; 219/121.5; 219/121.56; 216/67; 216/71; 313/231.31; 313/231.41; 313/231.51

(58) Field of Search ..... 134/1.1, 2, 31, 134/32, 34, 37; 219/121.4, 121.41, 121.48, 121.5, 121.56; 216/67, 71; 313/231.31, 231.41, 231.51

(56) References Cited

U.S. PATENT DOCUMENTS 5,693,241 A * 12/1997 Banks et al. ..... 219/121.11
5,837,958 A 11/1998 Förnsel
5,961,772 A * 10/1999 Selwyn ..... 156/345.39

FOREIGN PATENT DOCUMENTS

| | | |
|---|---|---|
| DE | 29503752 | 4/1995 |
| DE | 4338866 | 6/1995 |
| DE | 19648999 | 5/1998 |
| DE | 29805999 | 8/1998 |
| DE | 19532412 | 9/1999 |
| DE | 29919142 | 10/1999 |
| DE | 29921694 | 12/1999 |
| EP | 0995504 | 4/2000 |
| JP | 407090099 | * 4/1995 |

OTHER PUBLICATIONS

Merriam–Webster's Collegiate Dictionary, Tenth Edition, 1999. Page 1325, left column; p. 1192, right column.*

Hawley's Condensed Chemical Dictionary, Thirteenth Edition, 1997. Page 27.*

Patent Abstracts of Japan, vol. 1999, No. 03, corresponding to JP Publication No. 10321677, Dec. 1998.

* cited by examiner

*Primary Examiner*—Randy Gulakowski
*Assistant Examiner*—M. Kornakov
(74) *Attorney, Agent, or Firm*—Richard M. Goldberg

(57) ABSTRACT

A method of removing organic impurities from a surface of a substrate that is used for feeding or processing web material, wherein a jet of an atmospheric plasma is directed onto the surface of the substrate.

5 Claims, 2 Drawing Sheets

METHOD AND APPARATUS FOR CLEANING DRUMS OR BELTS

BACKGROUND OF THE INVENTION

The invention relates to a method and an apparatus for removing organic impurities from the surface of drums or belts.

Drums or belts that are used for conveying or processing web material such as paper, textiles or foils frequently have the problem that the surface of the drum or belt becomes stained with low-molecular organic compounds diffusing out of the treated web materials. For example, when paper is treated in printing presses it is known that conveyor drums, printing drums and the like are contaminated by wax that emerges from the paper. The same applies for photoconductors, fixing drums or intermediate image carriers, that are directly or indirectly brought into contact with copying paper in copying machines. Likewise, in processes for manufacturing or treating plastic foils, in particular when plastic foil is extruded from an elongated slot-type nozzle, conveyor drums or chill rolls are likely to become stained with organic compounds emerging from the freshly extruded plastic material. Since such impurities accumulate on the surface of the drum, it is necessary for a long-term proper operation of the equipment that such impurities are removed continuously or in certain intervals.

Heretofore, mechanical cleaning methods, chemical methods such as washing with solvents, and contact transfer methods or combinations of these methods have been used for this purpose.

In the contact transfer process, a cleaning drum rolls over the surface to be cleaned, and the surface material of the cleaning drum and the temperature conditions are adapted in accordance with the impurities to be removed and in accordance with the surface properties of the substrate to be cleaned, so that the impurities are transferred onto the surface of the cleaning drum by adhesion. These methods are however limited to a narrow spectrum of impurities and substrates and further have the drawback that it is relatively difficult to remove the impurities, in turn, from the surface of the cleaning drum. In another variant of the contact transfer process, a cleaning belt is used instead of a cleaning drum. Here, the same drawbacks are encountered. Although the problem to remove the impurities from the cleaning belt can in this case be eliminated by using disposable cleaning belts or wipers, the provision and the disposal of the consumable material leads to increased costs.

Mechanical cleaning methods are in many cases cumbersome and of poor efficiency and can easily lead to damage or wear of the surface to be cleaned.

Chemical methods are also relatively cumbersome in most cases, and in addition, are problematic in terms of environmental pollution because vapours of solvents are generated.

SUMMARY OF THE INVENTION

It is an object of the invention to provide a simple, efficient and widely applicable method for removing organic impurities, in particular low-molecular organic compounds, from the surface of drums or belts.

According to the invention, this object is achieved by directing a jet of an atmospheric plasma onto the surface.

U.S. Pat. No. 5,837,958 discloses a plasma nozzle capable of generating a jet of a relatively cool atmospheric plasma.

This plasma nozzle is mainly used for pre-treating plastic surfaces before they are coated with adhesives or lacquers or before they are printed on, so that the surface can more easily be wetted with liquids. This pre-treatment effect is due to the fact that the atmospheric plasma contains a high concentration of chemically highly reactive ions, radicals and excited atoms and molecules which reduce the surface tension of the treated substrate. The invention is based on the discovery that such an atmospheric plasma, thanks to its high reactivity, is also suitable for chemically destroying organic impurities, in particular low-molecular organic compounds, and for transforming them into volatile compounds which will then evaporate away from the treated surface. Since the atmospheric plasma has a comparatively low temperature, comparable to the temperature of a candle flame, and since it is sufficient for destroying the organic compounds that the plasma jet sweeps over the treated surface only for a short time, the method can be employed for a large variety of substrates to be cleaned without causing damage to the surface of the substrate itself. The above-mentioned effect that the surfaced tension of the substrate is reduced by the plasma treatment, is a welcomed side-effect in certain applications.

An apparatus according to the invention for cleaning drums or belts comprises at least one plasma nozzle which generates a jet of an atmospheric plasma directed onto the surface of the drum or belt, and which, in case of a drum, can be moved over the surface of the drum in axial direction of the drum and, in case of a belt, can be moved transversely to the feed direction of the belt, so that the entire width of the surface of the drum or belt, or at least the part of the surface to be cleaned, is swept by the plasma jet.

If a drum is rotating with relatively high speed, the plasma nozzle can be moved intermittently or with low speed in axial direction of the drum, so that an annular or helical track on the drum surface is cleaned during each revolution of the drum.

In case of a drum rotating at a relatively low speed or being driven only intermittently and in case of a belt, the plasma nozzle can be oscillated with relatively high speed, so that the surface of the drum or belt is swept by the plasma jet in width direction.

In both cases it is possible, by using a plurality of plasma nozzles moved together, to reduce the distance to be travelled by the individual nozzles to a fraction of the total working width.

The plasma nozzle may also be configured to generate a divergent plasma jet which has the shape of a cone or a fan and sweeps a larger area of the surface to be cleaned. Examples for such plasma nozzles are described in the German utility models DE 299 21 694 U1 and DE 299 19 142 U1.

DESCRIPTION OF PREFERRED EMBODIMENTS

Figure 1:
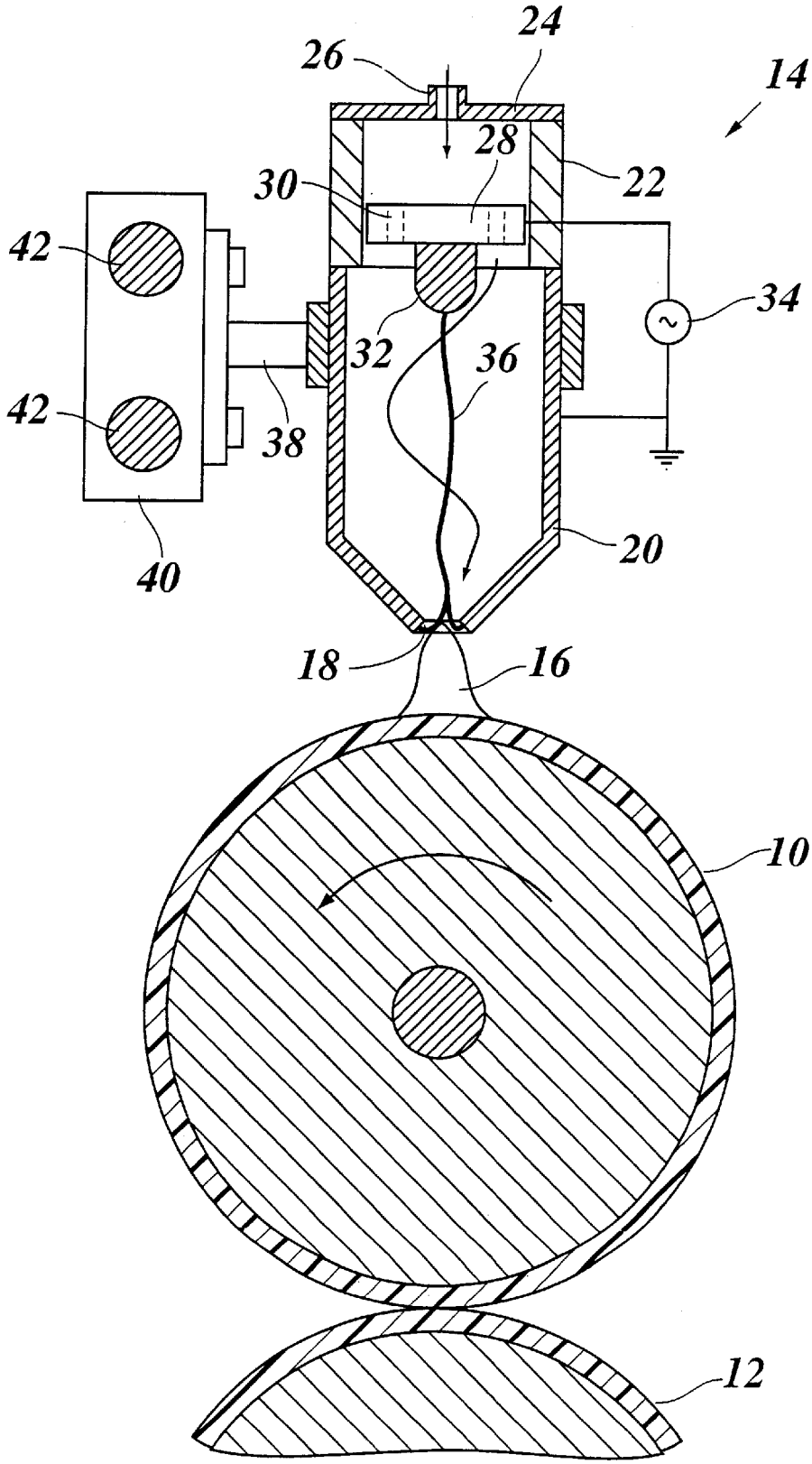
FIG. 1 shows a cross section of a drum to be cleaned and a sectional view of a plasma nozzle for cleaning the surface of the drum.

FIG. 1 shows a drum 10 which, together with another drum 12 forms a nip through which, for example, a web of paper may be fed. Wax and other low-molecular compounds which emerge from the paper may therefore accumulate on the surface of the drum 10 and have to be removed from time to time or continuously. To this end, a plasma nozzle 14 is arranged at the circumference of the drum 10, and this plasma nozzle is used for directing a jet 16 of an atmospheric plasma onto the surface of the drum 10.

The plasma nozzle 14 has a tubular outer electrode 20 which is electrically grounded and is tapered toward its mouth 18, and a tubular casing 22 made of an electrically insulating material such as ceramic is adjoined to the rear end of the outer electrode 20, i.e. the end opposite to the mouth 18. A cover 24 of the casing 22 forms an inlet port 26 through which a working gas, e.g. air, can be introduced into the plasma nozzle by means of a tube (not shown). In the interior of the casing 22 there is provided a swirl system 28 formed by a disk that fills the entire cross-section of the casing and has a ring of passages 30 that are inclined in the circumferential direction. In its center, the disk carries a stud-type inner electrode 32 which projects coaxially into the outer electrode 20.

In operation, the working gas flows through the plasma nozzle and is swirled by the swirl system 28 so that it flows in vortex fashion through the comparatively long outer electrode 20 towards the mouth 18, with a vortex core being formed on the central axis of the outer electrode 20. By means of a high-frequency high-voltage generator 34, a voltage in the order of 5 to 30 kV is applied to the central electrode 32. The frequency of the voltage is 10 to 20 kHz, for example.

The wall of the casing 22 made of ceramic forms a dielectric, so that the voltage applied to the central electrode 32 and the swirl system 28, which is also electrically conductive, produces at first a corona discharge by which an arc discharge between the central electrode 32 and the outer electrode 20 is ignited. The arc 36 of the arc discharge is entrained by a swirling flow of the working gas and is prevented from impinging directly onto the wall of the outer electrode 20. Instead, the arc is channelled in the vortex core of the swirled gas flow, so that it fans out to the outer electrode only when it has reached the mouth 18. Since the distance between the tip of the stud-type electrode 32 and the mouth 18 of the plasma nozzle is significantly larger than the diameter of the mouth 18, there is formed a comparatively long discharge path in which the working gas rotating with high velocity in the vortex core is brought into intimate contact with the electric arc. In this way, outside of the thermal plasma of the electric arc, there is formed a secondary plasma that is highly enriched with ions, excited atoms and molecules and highly reactive radicals. This secondary plasma is blown out through the mouth 18 and forms the plasma jet 16 which, due to the swirling motion, smoothly mates the surface of the drum 10. The impurities adhering to the surface of the drum are chemically destroyed by the chemically reactive components of the plasma and are transformed into volatile substances, which, in spite of the relatively low temperature of the plasma jet 16, evaporate from the surface of the drum 10. Thus, organic impurities can efficiently be removed from the surface of the drum 10.

The plasma nozzle 14 is held by an arm 38 that is adjustable in height relative to a carriage 40, so that the distance between the plasma nozzle 14 and the surface of the drum 10 can be adjusted as desired. The carriage 40 is guided on two guide-rods 42 and can be moved back and forth in axial direction of the drum 10 with suitable drive means that have not been shown.

When the drum 10 rotates with moderate speed or is rotated only intermittently, the plasma nozzle 14 is oscillated with relatively high velocity in axial direction of the drum, so that the plasma jet 16 sweeps over the surface of the drum in axial direction. During a complete cycle of the oscillating movement of the plasma nozzle 14 the drum 10 is rotated by an angle that is smaller than the angle covered by the plasma jet 16, so that the total surface of the drum 10 is cleaned continuously.

When the drum 10 rotates at higher speed, the plasma nozzle 14 is moved continuously or intermittently, and the average speed is so adjusted that the distance travelled by the plasma nozzle during one revolution of the drum is smaller than the width of the plasma jet 16.

Figure 2:
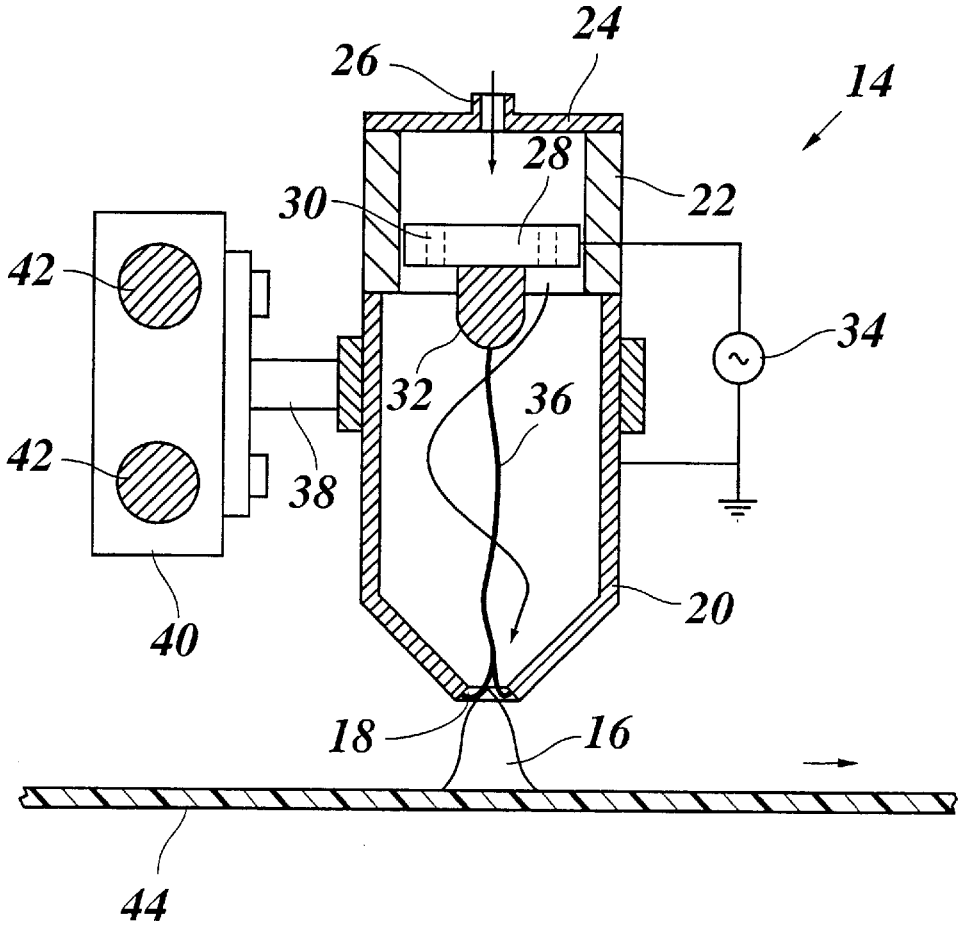
FIG. 2 shows the plasma nozzle as used for cleaning an endless belt.

The plasma nozzle 14 can be moved in the same manner when cleaning an endless belt 44, as has been shown in FIG. 2.

What is claimed is:

1. A method of removing organic impurities from a surface of one of a rotating drum and a belt moving in a feed direction that is used for feeding or processing web material, comprising the steps of igniting an arc discharge for producing an atmospheric plasma and directing a jet of said plasma in one of a divergent conical shape and a divergent fan-like shape from a plasma nozzle onto the surface of the one of the rotating drum and belt to remove organic impurities therefrom while the one of said rotating drum and belt is moving in the feed direction for feeding or processing the web material.

2. A method of removing organic impurities from a surface of a rotating drum that is used for feeding or processing web material, comprising the step of directing a jet of an atmospheric plasma onto the surface of the rotating drum, and wherein said step of directing includes the step of moving at least one plasma nozzle generating said plasma jet oscillatingly in an axial direction of the drum.

3. A method of removing organic impurities from a surface of a rotating drum that is used for feeding or processing web material, comprising the step of directing a jet of an atmospheric plasma onto the surface of the rotating drum, and wherein said step of directing includes the step of moving at least one plasma nozzle generating said plasma jet in an axial direction of the drum at a speed that is adapted to the rotary speed of the drum such that, during one revolution of the drum, the plasma nozzle travels a distance that is smaller than a width of the plasma jet.

4. A method of removing organic impurities from a surface of a belt moving in a feed direction that is used for feeding or processing web material, comprising the step of directing a jet of an atmospheric plasma onto the surface of the belt, and wherein said step of directing includes the step of moving at least one plasma nozzle generating said plasma jet over the belt transversely to said feed direction.

5. A method according to claim 1, further comprising the step of generating the plasma jet by a high frequency electric discharge in a swirled flow of a working gas.

* * * * *